US010386048B2

(12) United States Patent
Enck, Sr.

(10) Patent No.: US 10,386,048 B2
(45) Date of Patent: Aug. 20, 2019

(54) LANDSCAPE LIGHT MOUNTING SYSTEM WITH ORIENTATION ADJUSTMENT FEATURE

(71) Applicant: Jeffrey M. Enck, Sr., Lititz, PA (US)

(72) Inventor: Jeffrey M. Enck, Sr., Lititz, PA (US)

( * ) Notice: Subject to any disclaimer, the term of this patent is extended or adjusted under 35 U.S.C. 154(b) by 226 days.

(21) Appl. No.: 15/695,101

(22) Filed: Sep. 5, 2017

(65) Prior Publication Data

US 2018/0073709 A1 Mar. 15, 2018

Related U.S. Application Data

(60) Provisional application No. 62/385,305, filed on Sep. 9, 2016.

(51) Int. Cl.

| | |
|---|---|
| ***F21V 21/29*** | (2006.01) |
| ***F21V 21/08*** | (2006.01) |
| ***E04H 12/22*** | (2006.01) |
| ***F21V 21/116*** | (2006.01) |
| ***F21V 21/06*** | (2006.01) |
| *F21W 131/109* | (2006.01) |
| *F21V 27/02* | (2006.01) |
| *F21S 8/08* | (2006.01) |

(52) U.S. Cl.
CPC ..... *F21V 21/0824* (2013.01); *E04H 12/22* (2013.01); *F21V 21/06* (2013.01); *F21V 21/116* (2013.01); *F21S 8/08* (2013.01); *F21V 27/02* (2013.01); *F21W 2131/109* (2013.01)

(58) Field of Classification Search
CPC ..... F21V 21/0824; F21V 21/26; F21V 21/29; F21V 21/30; E04H 12/2215; E04H 12/223; E04H 12/2269; E04H 12/2284; F21W 2131/109; E02D 5/803
See application file for complete search history.

(56) References Cited

U.S. PATENT DOCUMENTS

| | | | | |
|---|---|---|---|---|
| 4,858,877 | A | 8/1989 | Carter | |
| 5,337,993 | A | 8/1994 | Hersman | |
| 5,649,760 | A | 7/1997 | Beadle | |
| 7,993,040 | B2 | 8/2011 | Beadle | |
| 2009/0323339 | A1* | 12/2009 | Janos | F21V 21/29 362/249.1 |
| 2016/0208509 | A1* | 7/2016 | Ngu | A45B 17/00 |

* cited by examiner

*Primary Examiner* — Suezu Ellis
(74) *Attorney, Agent, or Firm* — Miller Law Group, PLLC

(57) ABSTRACT

A landscape lighting mounting system has an orientation adjustment feature between the support shaft and the ground stake on which the lighting fixture is mounted. The ground stake has a vertical threaded opening into which the threaded shaft of a pivot ball can be mounted. The shaft of the lighting fixture has a retainer cap mounted on the lower distal end. The retainer cap is mounted onto the pivot ball and secured thereto with set screws which tightly engage the pivot ball after the shaft of the lighting fixture has been oriented into a selected orientation. Re-positioning the lighting fixture only requires the loosening of the set screws to re-orient the lighting fixture before retightening the set screws. The fixture wire for the landscape lighting fixture can pass through slots in the retainer cap or through the pivot ball and a slot in the top of the ground stake.

20 Claims, 4 Drawing Sheets

Fig. 2
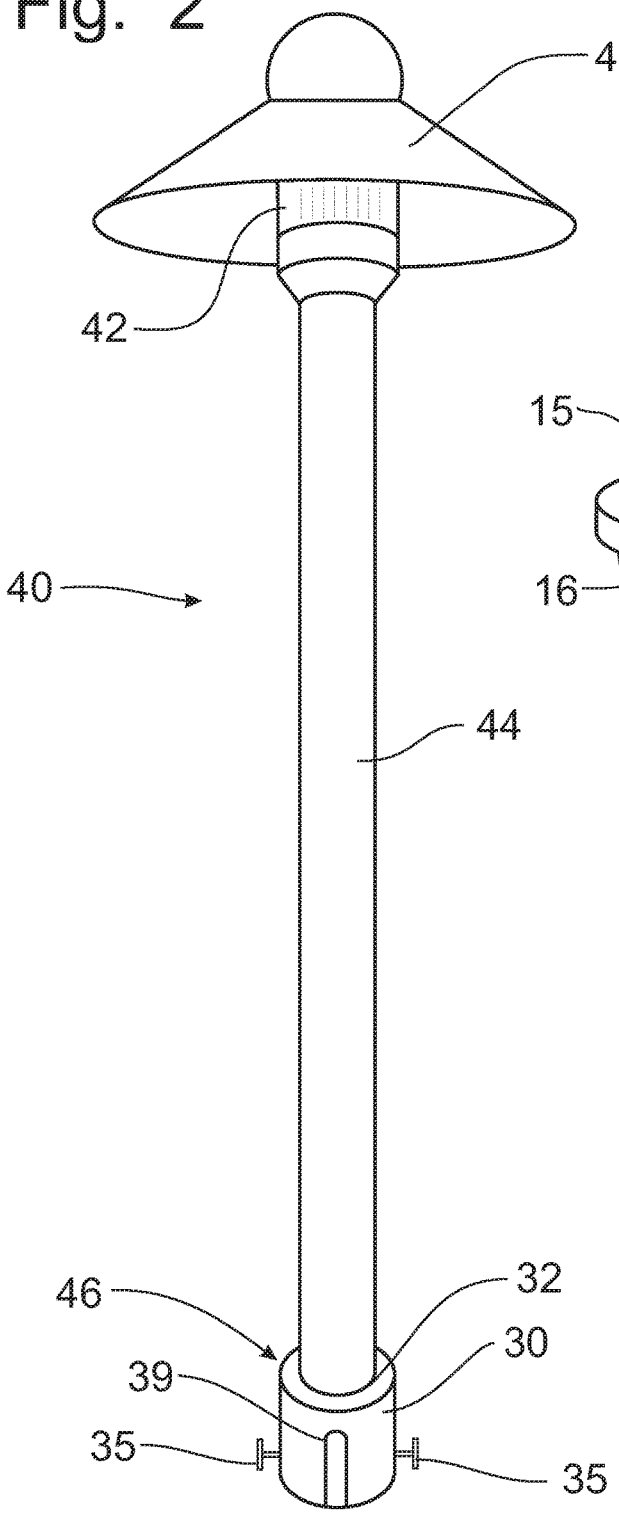
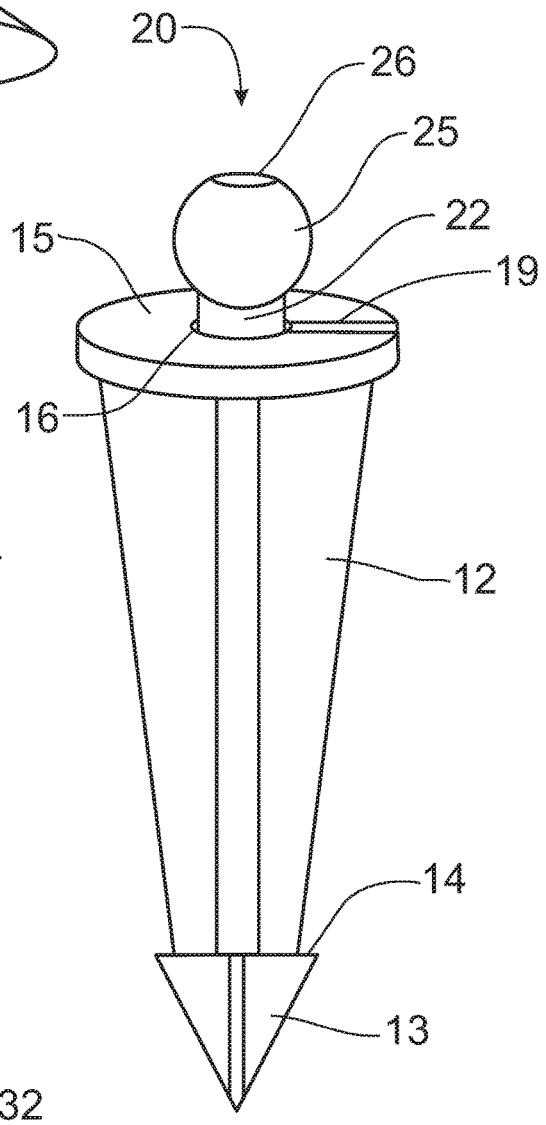
Fig. 3

LANDSCAPE LIGHT MOUNTING SYSTEM WITH ORIENTATION ADJUSTMENT FEATURE

CROSS-REFERENCE TO RELATED APPLICATIONS

This application claims domestic priority on U.S. Provisional Patent Application Ser. No. 62/385,305, filed on Sep. 9, 2016, the content of which is incorporated herein by reference.

FIELD OF THE INVENTION

The present invention generally relates to landscape lighting and, more particularly, to a landscape light mounting apparatus that incorporates a pivot mechanism to allow the lighting fixture to be oriented in a selected manner relative to the ground stake to which the lighting fixture is connected.

BACKGROUND OF THE INVENTION

Low voltage outdoor lighting fixtures have been widely utilized to illuminate buildings, landscaping, gardens, pathways, and entrance ways. The display of lighting in such areas is aesthetically pleasing and can provide sufficient lighting to permit a safe movement in such areas in the nighttime. Additionally, landscape lighting provides enhanced security by illuminating possible hiding places for intruders. Low voltage landscape lighting systems typically include multiple low voltage lighting fixtures that are electrically connected to a 120 volt transformer with a 12 volt output. The transformer can be plugged into a standard 120V electrical outlet. The multiple lighting fixtures are typically connected to the low voltage transformer with a copper low voltage wire. A solar collector panel that can be located on top of the lighting fixture, or remotely from the lighting fixture, so that electrical energy can be collected from a sunny location during the day to power the operation of the lighting fixture at night. Generally, each landscape lighting fixture includes a ground stake portion that is placed into the ground to support the mounting of the lighting fixture thereon.

Conventionally, the lighting fixture is mounted to the top of the ground stake and extends upwardly therefrom. Accordingly, care is usually taken to orient the ground stake vertically so that the lighting fixture mounted thereon will also be oriented vertically. However, occasionally obstructions beneath the surface of the ground will prevent the ground stake from being positioned vertically, usually resulting in the relocation of the ground stake to a less desirable location or the retention of the lighting fixture in a non-vertical orientation. Also, after the light fixture has been installed for a period of time, the movement of the ground due, to freezing and thawing, can cause the ground stake to move from its vertical position resulting in the light fixture being in a non-vertical orientation, as well.

Accordingly, it would be desirable to provide a landscape lighting system that can accommodate a misaligned ground stake.

A low voltage light fixture for use as a landscape light is disclosed in U.S. Pat. No. 4,774,648, granted to Jay J. Kabuk, et al, on Sep. 27, 1988, in which a ground stake is driven into the ground to support the mounting of a lighting fixture. The lighting fixture includes a male adapter that is configured to engage a corresponding female adapter on a post mounted onto the stake to provide clearance for the passage of electrical wires to the lighting fixture.

U.S. Pat. No. 4,858,877, granted to E. Ray Carter on Aug. 22, 1989, discloses a plastic standard for supporting a light fixture adjacent to the ground for utilization as a landscape light. The plastic ground stake passes through a stabilizer member buried beneath the surface of the ground to maintain positioning of the ground stake. The lighting fixture is simply affixed to the closed top end of the ground stake and connected to the electrical wiring extending upwardly through the ground stake.

U.S. Pat. No. 5,337,993, issued on Aug. 16, 1994, to Michael J. Hersman, teaches a stake-based support system for landscape lighting. The support system includes a fixed stand detachably connected to mounting pins buried in a block of concrete. A central spike is also inserted into the concrete and projects upwardly therefrom to terminate in a threaded pipe attached to the fixed stand to permit the detachable connection of a landscaping device. The landscape device can be a lighting fixture, a water sprinkler appropriately connected to a water supply through the fixed stand, a flagpole or any other devices utilized in the landscape industry.

The lighting fixture in the landscape lighting system disclosed in U.S. Pat. No. 5,649,760, issued to Joshua A. Beadle on Jul. 22, 1997, is mounted in a fixed housing member having a support therein configured to receive the lighting fixture. The lighting fixture, however, is movable within the housing member such that the lighting fixture can be oriented within the support to rest thereon without being fully seated within the support. Thus, the lighting fixture can be oriented to be directed into a different direction than the axial direction of the housing member.

A ground stake is disclosed in U.S. Pat. No. 7,993,040, granted to Joshua Beadle on Aug. 9, 2011, in which the top portion of the ground stake has an interior threaded member to receive a lighting fixture post and an exterior threaded member by which a protective housing for the lighting fixture can be mounted. The ground stake is molded to fit wiring and connectors within interior compartments, and to fit a transparent window on the side for observation of the interior connections.

None of the above-described prior art references teach or suggest a landscape lighting system that utilizes a ground stake and a pivot mechanism interconnecting the ground stake and the lighting fixture to permit an orientation of the lighting fixture relative to the ground stake. Accordingly, it would be desirable to provide a landscape lighting system that overcomes the aforementioned disadvantages of the known prior art to provide a landscape lighting system that incorporated an adjustability feature between the ground stake and the lighting fixture whereby the lighting fixture can be oriented vertically irrespective of the corresponding orientation of the ground stake as placed into the ground.

SUMMARY OF THE INVENTION

It is an object of this invention to provide a landscape lighting mounting system that has the capability of being positionally adjustable to vary the orientation of the landscape light after being positioned into the ground.

It is another object of this invention to provide an adjustment feature in a landscape light mounting system to enable positioning of the light into a vertical orientation irrespective of the orientation of the ground stake securing the landscape lighting fixture to the ground.

It is a feature of this invention that the adjustability feature is incorporated between the landscape lighting fixture and the ground stake securing the landscape lighting fixture to the ground.

It is an advantage of this invention that the adjustability feature provides a pivotal movement between the landscape lighting fixture and the ground stake.

It is another feature of this invention that the landscape lighting fixture is threaded into a retainer cap that is secured to the ground stake in a manner to permit pivotal movement of the landscape lighting fixture relative to the ground stake.

It is another advantage of this invention that the ground stake is provided with a pivot ball that is engaged by the retainer cap on which the landscape lighting fixture is mounted.

It is still another advantage of this invention that the retainer cap is secured to the ground stake pivot ball by set screws that fix the position of the retainer cap relative to the ground stake.

It is still another feature of this invention that the retainer cap is formed with vertical slots to allow the passage of electrical wires from the landscape lighting feature for connection to a source of electrical power.

It is yet another feature of this invention that the pivot ball can be formed with a vertical opening therethrough for the passage of electrical wires from the landscape lighting fixture through the pivot ball into an opening within the ground stake.

It is yet another advantage of this invention that the ground stake can be formed with a slot in the upper surface of the ground stake to permit passage of electrical wires from the lower distal end of the pivot ball for connection there to a source of electrical power.

It is still another advantage of this invention that the pivot ball includes a threaded vertical shaft that can be engaged into a threaded opening in the top surface of the ground stake to affect mounting of the landscape lighting fixture.

It is still another object of this invention to provide a method of placing a landscape lighting fixture in the ground that would include the steps of driving a ground stake into the ground at a selected location, installing a threaded pivot ball into a threaded opening in the top surface of the ground stake, mounting the landscape lighting fixture onto the pivot ball, orienting the landscape lighting fixture into a vertical orientation, and securing the vertically oriented landscape lighting fixture to the pivot ball by a plurality of set screws.

It is a further feature of this invention that the method of placing a landscape lighting fixture into the ground further includes the steps of securing a threaded shaft of the landscape lighting fixture into a threaded opening in a retainer cap, placing the retainer cap over the pivot ball, and receiving the set screws through the retainer cap into engagement with the pivot ball to secure the landscape lighting fixture into a desired orientation relative to the ground stake.

It is still a further feature of this invention that the electrical wiring for the landscape lighting fixture can be positioned through a vertical slot in the retainer cap or through a vertical opening within the pivot ball and then through a slot formed in the top surface of the ground stake.

It is a further object of this invention to provide a landscape lighting fixture having an orientation adjustment feature which is durable in construction, inexpensive of manufacture, carefree of maintenance, easy to assemble, and simple and effective in use.

These and other objects, features and advantages are accomplished according to the instant invention by providing a landscape lighting fixture having an orientation adjustment feature between the shaft of the light and the ground stake on which the landscape lighting fixture is mounted. The ground stake is provided with a vertical threaded opening into which a pivot ball having a threaded shaft can be mounted. The shaft of the lighting fixture has a threaded lower distal end that is received into a threaded retainer cap. The retainer cap is mounted onto the pivot ball and secured thereto with a plurality of set screws which can be tightened into engagement with the pivot ball after the shaft of the lighting fixture is oriented into a select orientation. Repositioning the lighting fixture if bumped into a non-vertical orientation only requires the loosening of the set screws to re-orient the lighting fixture and then retightening the set screws. Electrical wires can pass through slots in the retainer cap or in the top-surface of the ground stake.

BRIEF DESCRIPTION OF THE DRAWINGS

The advantages of this invention will be apparent upon consideration of the following detailed disclosure of the invention, especially when taken in conjunction with the accompanying drawings wherein:

FIG. 2 is an elevational perspective view of the lighting fixture with the retainer cap threaded onto the lower distal end of the elongated rod of the lighting fixture;

FIG. 3 is an elevational perspective view of the ground stake having the pivot ball threaded into a threaded opening in the upper surface of the ground stake according to the principles of the instant invention;

DETAILED DESCRIPTION OF THE PREFERRED EMBODIMENT

Referring to FIGS. 1-4, a landscape lighting system incorporating the principles of the instant invention can best be seen. Landscape lighting in general is intended to encompass both solar powered lighting fixtures and lighting fixtures connected electrically to a supply of electrical current. Landscape lighting is intended to encompass low voltage lighting fixtures placed along landscaping to provide illumination for the landscaped areas or to be placed along the edges of a walkway to illuminate the walkway. In such deployments, the lighting fixtures are typically elongated, such as by incorporating a rod or post between the support member placed into the ground and the light producing member positioned at the top of the rod or post.

Figure 1:
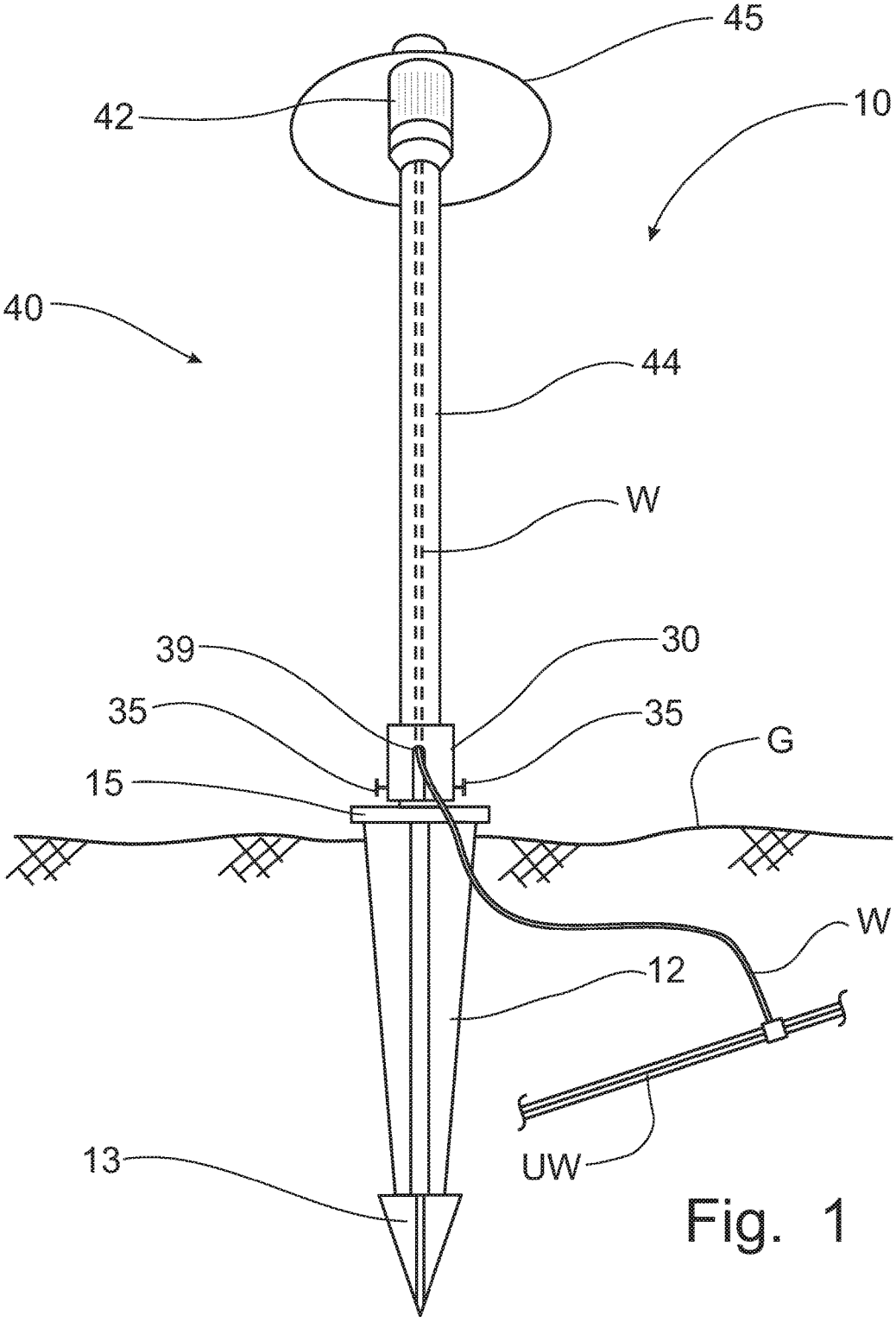
FIG. 1 is an elevational view of an assembled landscape lighting system incorporating the principles of the instant invention, with an upward perspective view into the lighting member.

Referring specifically to FIG. 1, the assembled landscape light system 10 is shown in an upright orientation with the typical level of the surface of the ground G being shown with dashed lines, as will be described in greater detail below. As noted, the ground stake 12 is preferably placed into the ground, typically through the use of a hammer that drives the pointed ground stake 12 into the surface of the ground G. Preferably, the lower point 13 of the ground stake 12 is shaped like an arrowhead such that the lower point 13 has a horizontally extending lip 14 that restricts the movement of the ground stake 12 out of the ground G. Accordingly, the lip 14 helps keep the ground stake 12 stabilized in the selected position therefor in the ground G.

Figure 4:
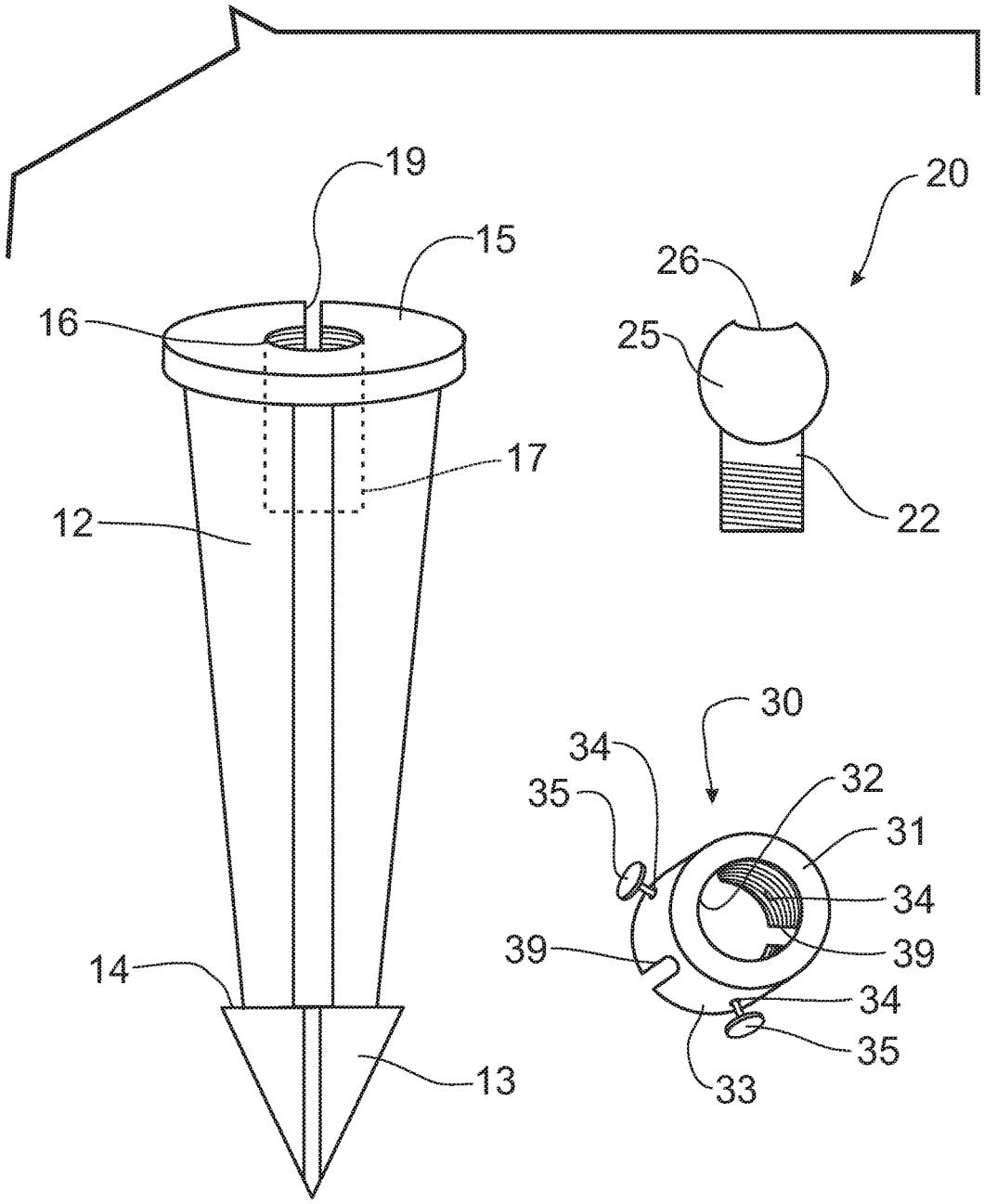
FIG. 4 is an elevational perspective view of the ground stake, separated pivot ball and retainer cap before being assembled into the landscape lighting system defining the principles of the instant invention.

As is best seen in FIG. 4, the ground stake 12 has a generally flat top surface 15 to facilitate the driving of the ground stake 12 into the ground G. The top surface 15 incorporates a threaded opening 16 into the interior of the ground stake 12. As is also seen in FIG. 4, adjacent the ground stake 12, a pivot member 20 includes a lower shaft 22, being threaded at the lower distal end to mate with the threaded opening 16 in the top surface 15 of the ground stake 12, and a top sphere or pivot ball 25 integrally formed, preferably, with the shaft 22. The threaded opening 16 is sized to receive the threaded shaft 22 of the pivot member 20 so as to be detachably secured to the ground stake 12 in a manner that the pivot member 20 extends perpendicularly from the flat top surface 15 of the ground stake 12, as is depicted in FIG. 3.

Further depicted in FIG. 4 is a retainer cap 30 having a threaded vertical opening 32 passing through the top portion 31 of the retainer cap 30. The retainer cap 30 is also formed with at least two, and preferably three, horizontal threaded openings 34 around a lower portion 33 of the retainer cap 30. Into each of the horizontal threaded openings 34 is fitted a set screw 35 that translates horizontally when manipulated with a screwdriver (not shown) or manually into and out of the retainer cap 30. As is depicted in FIG. 2, the retainer cap 30 can be threaded onto the lower end of the lighting fixture 40, as will be described in greater detail below.

The lighting fixture 40 is preferably formed with a low voltage light emitting member 42 at the top portion thereof and a support rod or shaft 44 that extends vertically therefrom. The length of the support rod 44 can be varied from one style of lighting fixture to another and, thus, can be short or long, but the support rod 44 needs to adapted at the lower distal end to engage into the threaded opening in the top of the retaining cap 30. The lighting fixture 40 can include a shade 45 at the top portion that is operable to direct the emitted light into a desired direction or configuration for the desired aesthetic purposes for utilizing the landscape lighting system 10. The top portion can also incorporate a solar voltaic cell (not shown) that generates electric energy during the day to be stored and utilized at night to illuminate the LED 42.

The preferred configuration for the engagement of the retaining cap 30 onto the lower, distal end of the support rod 44 of the lighting fixture 40 is to form both the lower distal end of the support rod 44 with threads 46 that mate with internal threads formed into the top of the retainer cap 30. Similarly, the engagement of the pivot member 20 into the opening in the top surface 15 of the ground stake 12 is preferably accomplished through mating threads formed in the central opening 16 and the shaft 22. However, one skilled in the art will recognize that other attachment methods can also be utilized, including pins fitting into bayonet joints, spring loaded detents, etc.

Once the retaining cap 30 has been secured onto the lower distal end of the support rod 44 and the pivot member 20 is engaged into the top surface 15 of the ground stake 12, the final assembly of the landscape lighting system 10 is to position the lower portion 33 of the retainer cap 30 so that the horizontal set screws 35 engage the top sphere 25 at a location below the equator of the top sphere 25. With the use of a screwdriver (not shown), the horizontal set screws 35 can be rotated inwardly into engagement with the surface of the top sphere or pivot ball 25 to secure the selected position of the lighting fixture 40 relative to the ground stake 12. Typically, the support rod 44 is positioned into a vertical orientation by pivoting the retainer cap 30 over the pivot ball 25 before the horizontal set screws 35 are tightened into engagement with the top sphere 25.

Figure 5:
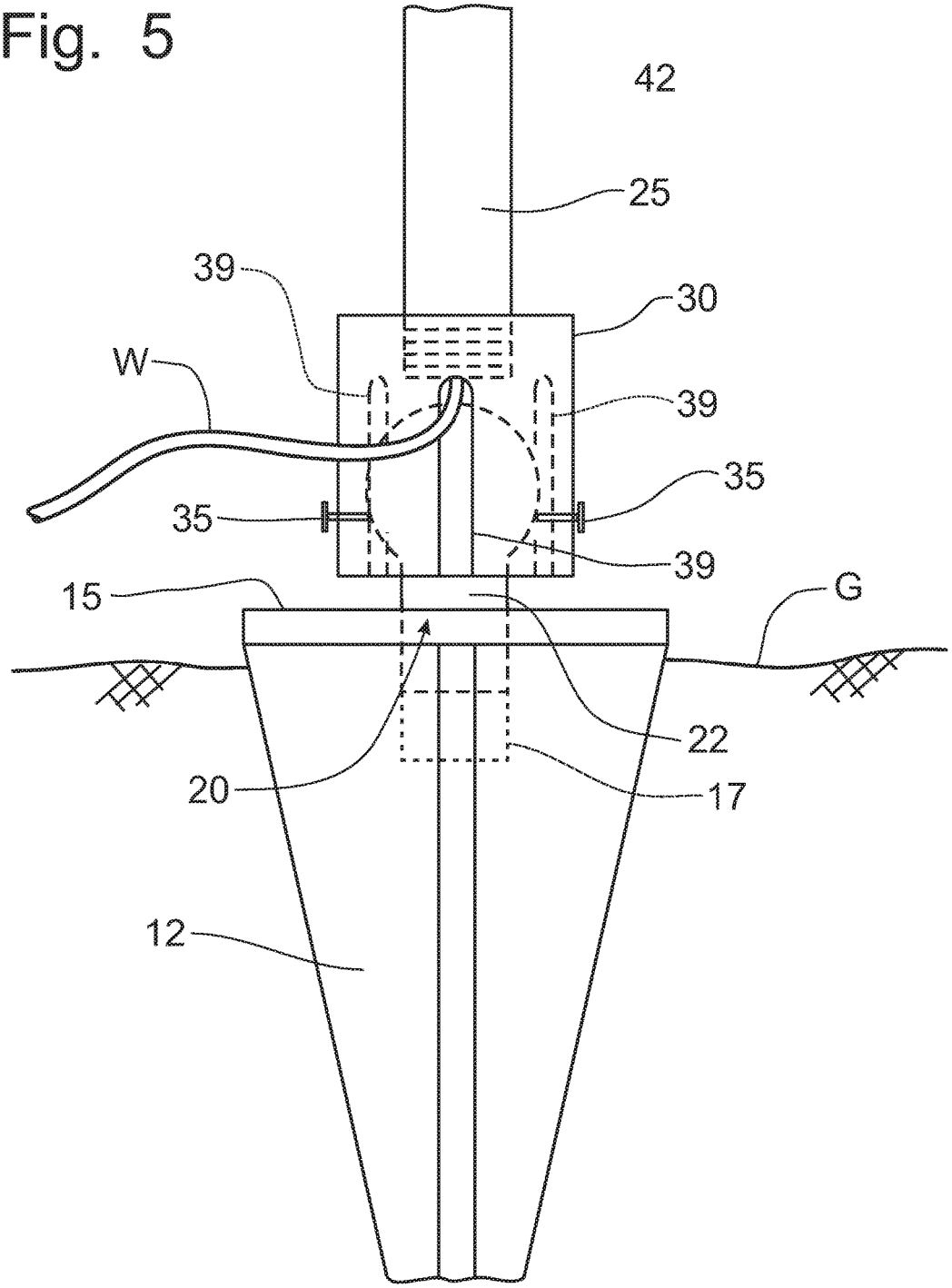
FIG. 5 is a partial elevational view of the retainer cap interconnecting the support rod and the pivot ball on the ground stake to depict an alternative configuration of the retainer cap having vertical slots to allow passage of electrical wiring into the support rod.

In certain configurations of the lighting fixture 40 that are electrically connected in series to 120V house current, the fixture wire W, which is connected to a low voltage underground wire UW, depicted in FIG. 1, that extends from a low voltage transformer to each of the lighting fixtures to provide electrical power thereto, needs to be accommodated in an aesthetically pleasing arrangement. To accomplish the disposition of the fixture wires W, the retainer cap 30 can be formed with one or more vertical slots 39, as is shown in FIG. 5, that can provide adequate room between the top of the slot 39 and the sphere 25 for the passage of the fixture wire W into the hollow support rod 44 to provide electrical power to the light emitting member 42. If needed, the ground stake 12, as is shown in FIG. 4, can incorporate a slot 19 formed into the top surface 15 to allow the positioning of the fixture wire W into the lighting fixture 40 through the pivot member 20.

In this configuration, as depicted in FIGS. 4 and 5, the pivot member 20 can be formed with a vertical passageway 26 that extends centrally through the shaft 22 and through the center of the top sphere 25. The fixture wire W can then be located through the hollow support rod 44 and into the passageway 26 through the pivot member 20 and exit the ground stake 12 through the formed slot 19. To facilitate the turning of the fixture wire W from the passageway 26 then upwardly through the slot 19, the interior of the ground stake 12 is preferably formed with an interior chamber 17, which can be larger than the opening 16, but would typically be simply an extension of the opening 16 that would extend deeper into the ground stake 12 than the elongated shaft 22 of the pivot member 20 can extend.

In operation, the installation of the instant landscape lighting system 10 would start with the deployment of the ground stake 12 into a selected location in the ground, preferably by striking a hammer against the flat top surface 15 until the flat top surface 15 is substantially level with the surface of the ground G, or at a predetermined height above the surface of the ground G. Although installation of the remaining components of the landscape lighting system 10 is facilitated by the ground stake 12 being deployed vertically, sometimes obstacles below the surface of the ground G will cause a slight deflection of the ground stake 12 such that the ground stake 12 is not perfectly vertical, and the flat top surface 15 is not perfectly horizontal. One of the advantages of the instant invention is that the lighting fixture 40 can still be vertically oriented even when the ground stake 12 is not vertical.

Once the ground stake 12 is installed into the ground G, the pivot member 20 can be inserted and secured, such as by threading, into the top surface 15 of the ground stake 12. The retainer cap 30 is also installed onto the lower distal end of the support rod 44, such as by threading the retainer cap 30 onto the support rod 44. If electrical connections are required, the electrical wires can be connected at this point in time. Then, the lighting fixture 40 may be positioned on top of the pivot member 20 resting on the top sphere 25, or slightly above the top of the pivot ball 25 in order to provide adequate room for the passage of electrical wires. Once the support rod 44 is oriented as desired, typically vertically, the set screws 35 can be tightened to complete the installation.

In configurations where the fixture wire W passes upwardly through the pivot member 20, the opening through the pivot member 20 should allow the passage of the fixture wire W into the hollow support rod 44, assuming that the orientation of the ground stake 12 is not substantially deviated from being vertical.

Once installed, the ground stake 12 is still subjected to re-positioning within the ground by freezing and thawing forces, or perhaps compaction of the ground surface adjacent the ground stake 12. Correction of the desired orientation of the lighting fixture 40 can be easily accomplished by loosening the horizontal set screws 35 with a screwdriver to allow an appropriate pivotal movement of the lighting fixture 40 over the top sphere 25 of the pivot member 20 to properly reposition the lighting fixture 40, whereupon the set screws 35 can be re-tightened to again secure the support rod 44 to the pivot member 20. Straightening the landscape lighting system 10 requires only the use of a screwdriver, and does not involve pulling and re-positioning the ground stake 12.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiments of the invention; however, concepts, as based upon the description, may be employed in other embodiments without departing from the scope of the invention.

Having thus described the invention, what is claimed is:

1. A landscape lighting system comprising:

a ground stake having a flat top surface positionable proximate to the surface of the ground;

a pivot member secured to the top surface of said ground stake to position a sphere above said top surface of said ground stake;

a lighting fixture having a support rod and a light member mounted on said support rod; and a retainer cap mounted on a distal end of said support rod remote from said light member, said retainer cap being sized to receive said sphere into said retainer cap, said retainer cap including a securing device selectively engagable to engage said sphere to secure said support rod thereto after said support rod has been positioned in a desired orientation.

2. The landscape lighting system of claim 1 wherein said pivot member includes a shaft member connected to said sphere, said shaft member being engaged with said ground stake to locate said sphere above said top surface of said ground stake.

3. The landscape lighting system of claim 2 wherein said shaft member of said pivot member is threaded into an opening formed into the top surface of said ground stake.

4. The landscape lighting system of claim 3 wherein said sphere and said shaft member have an aligned vertical opening passing therethrough and in communication with a hollow passageway extending through said support rod to allow passage of a fixture wire to said light member.

5. The landscape lighting system of claim 1 wherein said securing device on said retainer cap includes a plurality of set screws received within threaded openings formed into said retainer cap, said set screws being translated into engagement with said sphere to secure the retainer cap to said sphere.

6. The landscape lighting system of claim 5 wherein said retainer cap is threaded onto said distal end of said support rod.

7. The landscape lighting system of claim 5 wherein said retainer cap is formed with vertical slots for the passage of the fixture wire into the support rod.

8. A method of installing a landscape lighting system including the steps of:

driving a ground stake into the ground, said ground stake having a flat top surface oriented generally horizontally after said ground stake has been driven into the ground;

threading a pivot member having a top sphere and a shaft threaded at the lower distal end remotely from said top sphere into a threaded opening in said top surface of said ground stake;

connecting a retainer cap onto a distal end of an elongated support rod of a landscape light having a lighting member supported at the opposing end of said support rod;

placing said retainer cap over said pivot member and orienting said support rod in a vertical orientation;

securing the retainer cap to said top sphere by positioning a plurality of set screws through corresponding threaded openings in said retainer cap into engagement with said top sphere below a central equator of said top sphere.

9. The method of claim 8 wherein said support rod can be re-oriented after installation thereof by the steps of:

loosening at least one of said set screws to permit movement of said support rod relative to said pivot member;

moving said support rod into a desired orientation; and re-tightening said set screws to secure said support rod to said pivot member.

10. The method of claim 8 wherein said retainer cap is formed with at least one vertical slot for the passage of a fixture wire through a selected one of said at least one vertical slot into a hollow passageway through said support rod to provide electrical power to said lighting member.

11. The method of claim 8 wherein said top surface of said ground stake is formed with a slot to allow passage of a fixture wire into a hollow compartment formed into said ground stake below said top surface, said pivot member being formed with a vertical opening extending through said shaft and said top sphere to be in communication with a hollow passageway through said support rod to permit passage of said fixture wire to said lighting member to provide electrical power thereto.

12. The method of claim 8 wherein said retainer cap is formed with a vertically extending threaded opening for receipt of said distal end of said support rod which is threaded to engage said threaded opening in said retainer cap.

13. A landscape lighting system comprising:

a ground stake having a flat top surface positionable proximate to the surface of the ground, said ground stake including an opening in said top surface;

a pivot member having a pivot ball and an elongated shaft and being detachably secured to the ground stake by insertion of the elongated shaft into said opening in said top surface of said ground stake to position said pivot ball above said top surface of said ground stake;

a lighting fixture having an elongated hollow support rod and a light member mounted on one end of said support rod, said support rod having a distal end remote from said light member; and a retainer cap mounted on said distal end of said support rod, said retainer cap being sized to receive said pivot ball into said retainer cap, said retainer cap including a securing device selectively engagable with said pivot ball to secure said retainer cap to said pivot ball after said support rod has been positioned in a desired orientation.

14. The landscape lighting system of claim 13 wherein said elongated shaft of said pivot member secures said pivot ball at one end and is threaded at the opposing distal end, said opening in said top surface of said ground stake being threaded to receive said elongated shaft for engagement therebetween.

15. The landscape lighting system of claim 14 wherein said pivot ball and said elongated shaft have a passageway extending axially therethrough, said passageway being at least partially aligned with said hollow support tube when said retainer cap is mounted on said pivot ball.

16. The landscape lighting system of claim 15 wherein said ground stake is formed with an interior chamber which is in communication with said threaded opening through the top surface of said ground stake, said ground stake also being formed with a slot in communication with said interior chamber to permit positioning of a fixture wire through said slot and said passageway into said hollow support rod.

17. The landscape lighting system of claim 13 wherein said retainer cap is formed with at least one vertical slot for the passage of a fixture wire into said retainer cap and into said hollow support rod mounted on said retainer cap.

18. The landscape lighting system of claim 13 wherein said retainer cap is formed with a threaded hole in a top portion thereof, said distal end of said support rod being threaded for engagement with said threaded hole.

19. The landscape lighting system of claim 13 wherein said securing device is a plurality of spaced apart set screws threaded into a side portion of said retainer cap and being movable with respect to said retainer cap to engage said pivot ball to secure said retainer cap to said pivot ball.

20. The landscape lighting system of claim 19 wherein said set screws can be selectively disengaged from said pivot ball to permit re-orientation of said lighting fixture relative to said ground stake.

* * * * *